United States Patent [19]

Childs

[11] 4,376,418

[45] Mar. 15, 1983

[54] PORTLIGHT FOR MARINE USE

[76] Inventor: John M. Childs, 13031 Deva St., Coral Gables, Fla. 33156

[21] Appl. No.: 202,272

[22] Filed: Oct. 30, 1980

[51] Int. Cl.[3] ..... B63B 19/00

[52] U.S. Cl. ..... 114/178

[58] Field of Search ..... 114/173, 177, 178, 203; 49/50, 56, 57, 61, 71, 261, 471; 160/92

[56] References Cited

U.S. PATENT DOCUMENTS

| | | | |
|---|---|---|---|
| 523,137 | 7/1894 | Tremmel | 49/50 |
| 2,121,386 | 6/1938 | Henrickson | 114/203 |
| 3,779,198 | 12/1973 | Gray | 114/178 |
| 4,095,640 | 6/1978 | Beckerer | 114/178 |

*Primary Examiner*—Charles E. Frankfort
*Assistant Examiner*—Jesus D. Sotelo
*Attorney, Agent, or Firm*—Ernest H. Schmidt

[57] ABSTRACT

An integrally-formed portlight for installation through a sidewall opening in the cabin or hull structure of a marine vessel has an inwardly-projecting, rectangular spigot portion within which a rectangular light or screen can be selectively fitted. The light is hingingly supported along its top edge within the spigot to provide for upward opening to the inside for substitution of a rectangular screen, the screen being received, along an upper marginal edge portion, within the groove between the upper edge of the light, when withdrawn, and a peripheral shoulder formed within the spigot. Lower end portions of the light or screen are clamped in place against the peripheral shoulder of the spigot with use of elongated clamp-screws threadingly received in upstanding brackets secured to outer end portions of the spigot along the bottom wall thereof.

11 Claims, 5 Drawing Figures

PORTLIGHT FOR MARINE USE

BACKGROUND OF THE INVENTION

This invention relates to marine portlights, and is directed particularly to portlights for above water installation providing for selective use of either a light or a screen, as desired.

The use of window sashes or frames in which windows or screens can be installed for use either independently or in combination are well known in building construction. Such known windows, however, are not readily adaptable to marine use because of the vastly different conditions of usage and installation in the marine setting. It is, accordingly, the principal object of this invention to provide a novel and improved portlight for marine use, particularly for use in pleasure boats, yachts, and other relatively small ocean-going vessels.

A more particular object of the invention is to provide a portlight of the above nature which, although not adapted for submersible use, is substantially water-tight and provides for self-drainage from the outside.

Another object of the invention is to provide a portlight of the character described wherein installation is made through a side-wall opening in the vessel from the outside, and wherein its frame is provided at the outside with a split or divided peripheral mounting flange, portions of which can be flexed upon installation to accommodate to curvatures in the outer wall surface surrounding the opening in which the frame is to be installed.

Yet another object is to provide a portlight of the character described wherein the peripheral flange is integrally formed with the portlight frame, whereby the pressure of water impinging against the outside of the light fitted in the frame will be transferred through the frame to the outside of the vessel hull, thereby obviating any tendency to loosen the sash light frame, as might otherwise occur in constructions wherein the frame flange is secured against the inside of the hull opening.

Yet another object of the invention is to provide a portlight wherein the light is hinged along its upper edge to the frame spigot portion extending into the cabin in which the frame is installed, to provide for selective withdrawal of the light for replacement by a screen.

Other objects are to provide a portlight which will be simple in construction, economical to manufacture, easy to install and operate, and durable and attractive in use.

Still other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
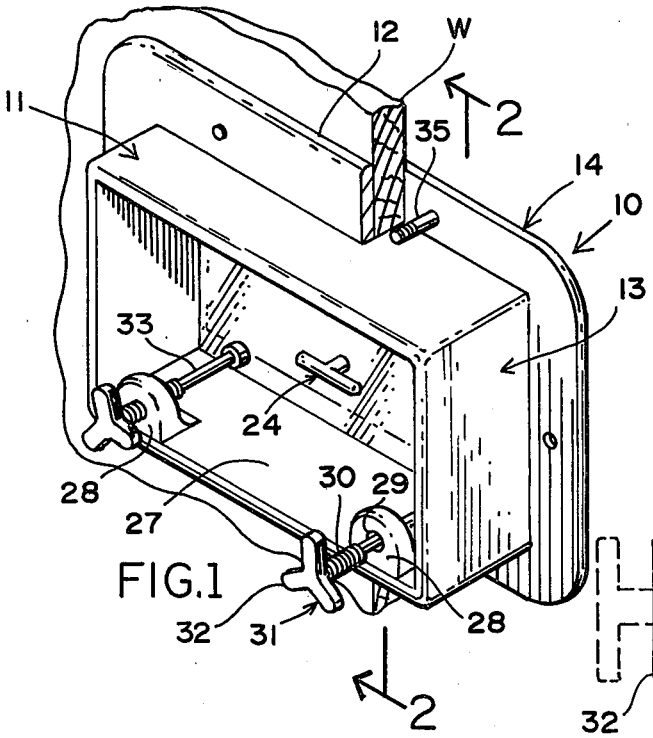
FIG. 1 is an oblique view, as viewed from above and from the inside, of a portlight embodying the invention, showing cutaway portions of the cabin side-wall structure in which it is installed.

Referring now in detail to the drawings, reference numeral 10 designates, generally, a portlight embodying the invention shown installed on the side-wall W (partially illustrated) of the cabin, for example, of a marine vessel. The portlight 10 comprises a frame member 11 and an inner trim ring 12, fabricated, preferably, of a tough, substantially rigid synthetic plastic material such as Nylon. The frame member 11 comprises a spigot portion 13, which will preferably be of elongated, generally rectangular shape, fitted about the outer peripheral edge with a perpendicularly-outwardly-extending flange 14 which will be either integrally-formed with said spigot portion or partially split or sectioned to accommodate for better fit against the outer wall surface of a boat hull or cabin wall upon installation, as is hereinafter more particularly described. The interior opening of the spigot portion 13 is rectangular in shape, as illustrated in FIG. 1, and is integrally formed at its outer end with a peripheral, inwardly-extending lip portion 15 defining, at the inside, a rectangular, peripheral shoulder 16, and, at the outside, a divergent peripheral surface or bevel 17 having an obtuse angle of approximately 130 circular degrees with the horizontal. The outer periphery of the flange 14 will preferably be rounded, as indicated at 18 in FIGS. 2 and 3.

Means is provided for fitting the spigot portion 13 of the frame member 11, upon installation as is hereinafter described, with either a light (window) or screen, selectively. To this end, as best illustrated in FIG. 2, a rectangular light or window 19, preferably of clear plexiglass, is hinged along its upper edge, as by piano hinge 20, against the upper inner wall of said spigot portion so that when swung in a vertical downward or closed position, it abuts the peripheral shoulder 16 in close fitting engagement, as illustrated by the full-line representation of said light in FIG. 2.

Figure 4:
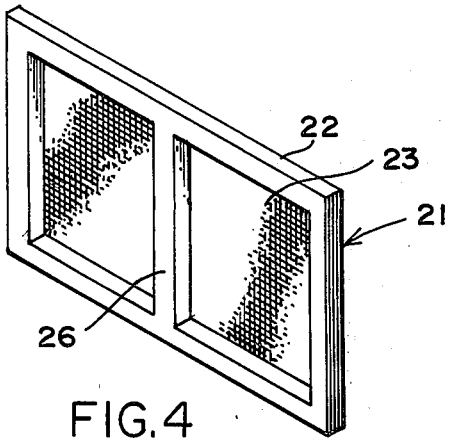
FIG. 4 is an oblique view of the screen, shown separately.
Figure 3:
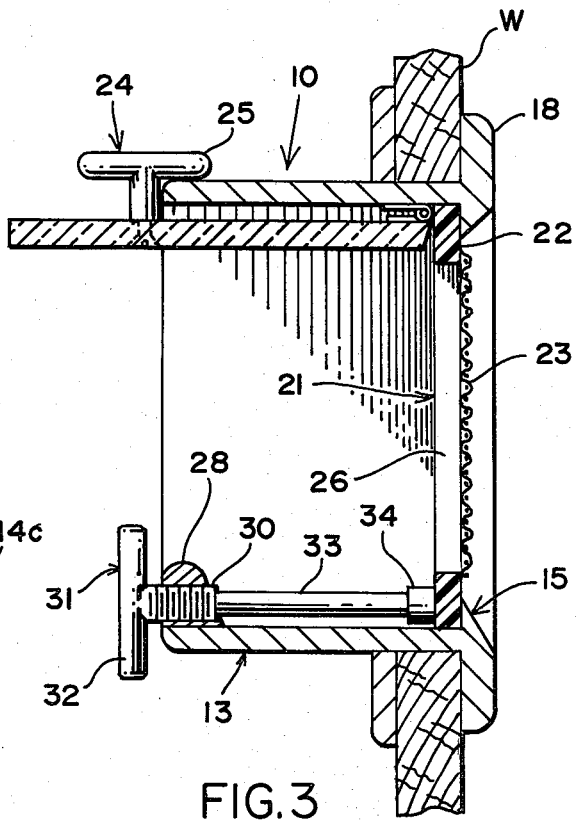
FIG. 3 is a vertical cross-sectional view similar to that of FIG. 2, but illustrating the light in withdrawn position and replaced by a screen.

FIG. 3 illustrates how a screen 21 can be substituted for the light 19 when said light, as illustrated in FIG. 3, is swingingly withdrawn to fully open position. The screen 21, which is also illustrated separately in FIG. 4, comprises a molded, rectangular frame 22 against the outside of which screening 23 is cemented or otherwise affixed. It is of the same rectangular shape as that of the light 19, and is thin enough to be received along its upper marginal edge between frame shoulder 16 and the inner edge of the light when in its withdrawn position, as illustrated in FIG. 3. As further illustrated in FIG. 3, the light 19 is fitted, centrally along its length, with a rotary hook 24 having latch portion 25 which can be turned into engagement over a top surface portion of the frame spigot portion 13 to retain it in laterally withdrawn position while the screen 21 is being used. It is to be noted that rotary hook 24, which may also be fabricated of a tough, synthetic plastic material, serves as a handle for opening and closing the light in its portlight frame. In this connection it is to be noted that, as illustrated in FIG. 4, the screen frame 22 is integrally formed with a central, vertical support post portion 26 which serves as a handle for insertion and removal of the screen 21 in the portlight frame.

Means is further provided for releasably clamping either the light 19 or the screen 21 in place in the portlight frame. To this end, as best illustrated in FIGS. 1 and 2, the bottom wall 27 of the frame member spigot portion 13 is fitted, near each end thereof, with an upstanding bracket 28 having an internally-threaded, front-to-back opening 29 adapted for inter-threading engagement with the threaded shank portion 30 of a clamp screw 31. The outer end of the threaded shank portion 30 of the clamp screw 31 is integrally-formed with a turn handle 32, whereas the inner end of said shank portion extends axially into a reduced-diameter extension rod portion 33 terminating in synthetic plastic foot 34. As illustrated by the full-line representation thereof in FIGS. 2 and 3, the clamp screws 31 are of such length that, when threaded into their respective brackets 28, the feet 34 thereof will clampingly constrain lower marginal inside portions of the light 19 (or screen 21) against the lower side of the frame shoulder 16, thereby securely retaining it in place. To remove and replace either the light 19 or the screen 21, it is only necessary to unscrew the clamp screws 31 to allow withdrawal of the reduced-diameter shank portion 33. As illustrated by the broken-line representation thereof in FIG. 2, the brackets 28 are so spaced from the frame opening and of such small relative height as not to interfere with insertion and removal of the screen 21, or the opening and closing swinging movement of the light 19. The upstanding brackets 28 may either be integrally-molded with the frame spigot portion 13 or secured thereto with use of a suitable cement, with or without use of interconnecting screws.

Figure 2:
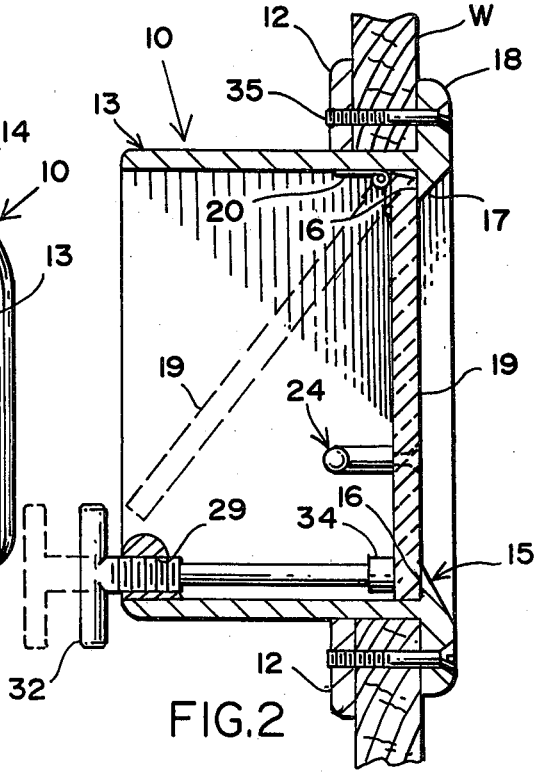
FIG. 2 is a vertical cross-sectional view taken along the plane indicated at 2—2 of FIG. 1 in the direction of the arrows.

As illustrated in FIGS. 1 and 2 the portlight is installed by passing spigot portion 13 through an opening in the side-wall W of the cabin or hull of the vessel so that the outer flange 14 abuts a marginal, peripheral zone at the outer surface of the opening. The rectangular trim ring 12 fits over the frame spigot portion 13 at the inside, and is clamped to the flange 14 by a plurality of bolts 35, thereby sandwiching a peripheral marginal zone of the hull or cabin opening thereinbetween.

Figure 5:
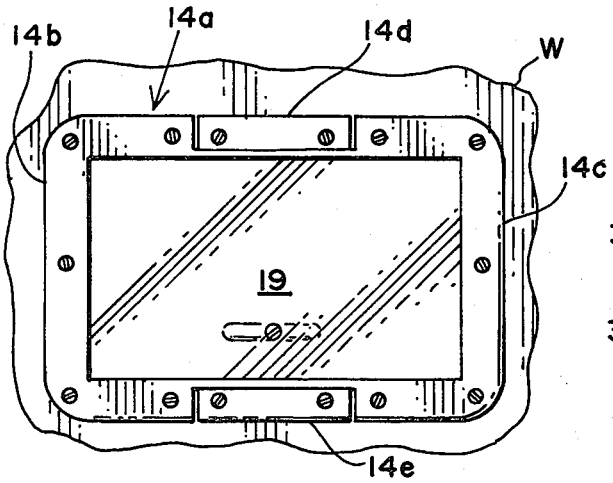
FIG. 5 is an outside elevational view of the portlight illustrating how the outer flange can be sectioned to provide limited flexibility for tight fitting against hull or cabin walls having slight curvatures.

In instances where the outer surface of the wall within which the portlight to be installed is curved, as is often the case, the flange 14, instead of being of unitary construction integral with the frame spigot portion 13, could instead be of divided or sectioned construction, as illustrated in FIG. 5, to provide for bending, and therefore better conformance against the outer wall upon installation. Thus, as illustrated in FIG. 5, outer end portions **14*b* and 14*c* of alternative flange 14*a* could be integrally formed with spigot portion 13, leaving upper and lower gaps to be filled in by separate upper and lower flange portions 14*d*, 14*e* which can readily be flexed upon installation to better conform with the curved outer surface. Alternatively, particularly with reverse or concave curvatures, the central flange portions 14*d* and 14*e* could be integrally formed with the frame spigot, and end portions 14*b* and 14*c*** separately applied for better conformation.

While I have illustrated and described herein only two forms in which the invention can conveniently be embodied in practice, it is to be understood that these embodiments are presented by way of example only and not in a limiting sense. The invention, in brief, comprises all the embodiments and modifications coming within the scope and spirit of the following claims.

What I claim as new and desire to secure by Letters Patent is:

1. In a portlight for installation through a side wall opening of a marine vessel from the outside, the improvement comprising, a rectangular frame member, said frame member being integrally formed with a tubular spigot portion defining a rectangular through opening and a flange extending perpendicularly-outwardly of one end of said spigot portion, and inwardly-extending peripheral lip at said one end of said spigot portion, said lip defining an interior, perpendicularly, peripheral shoulder at the inside of said one end of said spigot portion, a rectangular light of substantially same size and shape as said rectangular through opening in said tubular spigot portion, means for securing an upper end portion of said rectangular light against an inside upper wall portion of said spigot portion for holding the upper end of said light against said shoulder, and clamp means for removably securing the lower end portion of said light against said shoulder, whereby, upon installation of the portlight, the pressure of water impinging against the outside of the light fitted in the frame will be transferred through the frame to the outside of the vessel hull.

2. A portlight as defined in claim 1, wherein said light securing means comprises a hinge pivotally joining the inner upper edge of said light with said upper wall portion of said frame spigot portion, whereby said light can be swingingly withdrawn from the vertical closure position to the horizontal opening position with respect to said rectangular opening upon release of said clamp means, and a screen member of substantially the same rectangular size as said light and receivable along its upper end in the groove between said shoulder and the inner edge of said light when in its withdrawn position for its secure retention in place within said frame in substitution for said light upon closure of said clamp means against the lower end portion of said screen member.

3. A portlight as defined in claim 2 wherein said clamp means comprises a bracket fixed with respect to and extending upwardly of a bottom wall portion of said spigot portion at the other end thereof, a front-to-back, internally-threaded opening in said bracket, and a clamp screw having a threaded shank portion engageable with said internally-threaded opening and having a reduced-diameter, axially-extending extension rod portion operative to clampingly abut a lower outer surface portion of either said light or said screen, selectively, fitted within said spigot portion against said peripheral shoulder.

4. A portlight as defined in claim 3 including an inwardly-projecting hook means secured to said light and engageable with an upper wall portion of said spigot portion for securing said light in said horizontal open position.

5. A portlight as defined in claim 4 wherein said hook means comprise a rotary hook member having a radially-extending flange portion adapted to be turned over an upper surface portion of said upper wall portion of said frame spigot portion.

6. A portlight as defined in claim 5 wherein said rotary hook member serves as a handle for upward swinging of said light to its open position.

7. A portlight as defined in claim 6 wherein said screen member comprises a rectangular screen frame having an integrally formed central post, and a screen the peripheral edge of which is secured against the outside of said screen frame, whereby said post can be grasped from the inside for removal and replacement of said screen member.

8. A portlight as defined in claim 3 wherein said peripheral lip further defines a divergent, peripheral surface at the outside of said inner end of said spigot portion having an obtuse angle of approximately 130 circular degrees with the interior surface of said tubular spigot portion.

9. A portlight as defined in claim 3 wherein said flange is integrally formed with and extends peripherally about said one end of said spigot portion.

10. A portlight as defined in claim 3 wherein portions of said flange are integrally formed with said one end of said spigot portion, and other portions of said flange are separate, said separate flange portions, when fitted between said integral flange portions, defining together a peripheral composite flange extending perpendicularly outwardly of said end of said spigot portion.

11. A portlight as defined in claim 3 and further including a trim ring having a central rectangular opening for close fit circumjacent said spigot portion.

* * * * *